US010450875B2

(12) United States Patent
Weber et al.

(10) Patent No.: US 10,450,875 B2
(45) Date of Patent: Oct. 22, 2019

(54) VARYING GEOMETRIES FOR COOLING CIRCUITS OF TURBINE BLADES

(71) Applicant: General Electric Company, Schenectady, NY (US)

(72) Inventors: David Wayne Weber, Simpsonville, SC (US); Sandip Dutta, Greenville, SC (US); Brendon James Leary, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 141 days.

(21) Appl. No.: 15/334,585

(22) Filed: Oct. 26, 2016

(65) Prior Publication Data

US 2018/0112538 A1 Apr. 26, 2018

(51) Int. Cl.
*F01D 5/18* (2006.01)

(52) U.S. Cl.
CPC ..... *F01D 5/187* (2013.01); *F05D 2240/304* (2013.01)

(58) Field of Classification Search
CPC ..... F05D 2220/32; F05D 2260/202; F05D 2260/204; F01D 5/186; F01D 5/187
See application file for complete search history.

(56) References Cited

U.S. PATENT DOCUMENTS 2,744,723 A 5/1956 Roush
3,220,697 A 11/1965 Smuland et al.
3,844,679 A 10/1974 Grondahl et al.
3,849,025 A 11/1974 Grondahl
4,021,139 A 5/1977 Franklin
4,302,153 A 11/1981 Tubbs
4,684,322 A 8/1987 Clifford et al.
4,761,116 A * 8/1988 Braddy ..... F01D 5/187 415/115

(Continued)

FOREIGN PATENT DOCUMENTS

EP 1533474 A2 5/2005
EP 1793085 A2 6/2007

OTHER PUBLICATIONS

U.S. Appl. No. 15/334,483, Office Action dated Jun. 28, 2018, 13 pages.

(Continued)

*Primary Examiner* — Kenneth Bomberg
*Assistant Examiner* — Andrew Thanh Bui
(74) *Attorney, Agent, or Firm* — Dale Davis; Hoffman Warnick LLC

(57) ABSTRACT

Various geometries for a trailing edge cooling system for a turbine blade. The trailing edge cooling system may include a plurality of cooling circuits extending at least partially along a radial length of a trailing edge of the turbine blade. Each cooling circuit may include an outward leg extending axially toward the trailing edge, and a plurality of turn legs in fluid communication with the outward leg. The plurality of turn legs may be positioned adjacent the trailing edge. Each cooling circuit may also include a return leg positioned adjacent the outward leg and extending axially from the trailing edge. The return leg may include a first portion and a second portion. The first portion may have a first width, and a second may have a second width that is greater than the first width of the first portion.

20 Claims, 9 Drawing Sheets

(56) References Cited

U.S. PATENT DOCUMENTS

| | | | | |
|---|---|---|---|---|
| 4,940,388 | A | 7/1990 | Lilleker et al. | |
| 5,100,293 | A | 3/1992 | Anzai et al. | |
| 5,236,309 | A | 8/1993 | Van Heusden et al. | |
| 5,350,277 | A | 9/1994 | Jacala et al. | |
| 5,464,322 | A | 11/1995 | Cunha et al. | |
| 5,536,143 | A | 7/1996 | Jacala et al. | |
| 5,915,923 | A * | 6/1999 | Tomita | F01D 5/187 415/115 |
| 5,967,752 | A | 10/1999 | Lee et al. | |
| 5,997,251 | A | 12/1999 | Lee | |
| 6,099,252 | A | 8/2000 | Manning et al. | |
| 6,227,804 | B1 | 5/2001 | Koga et al. | |
| 6,247,896 | B1 | 6/2001 | Auxier et al. | |
| 6,422,817 | B1 | 7/2002 | Jacala | |
| 6,499,949 | B2 | 12/2002 | Schafrik et al. | |
| 6,547,522 | B2 | 4/2003 | Turquist et al. | |
| 6,547,525 | B2 | 4/2003 | Haehnle et al. | |
| 7,435,053 | B2 * | 10/2008 | Liang | F01D 5/187 416/97 R |
| 7,530,789 | B1 | 5/2009 | Liang | |
| 7,670,113 | B1 * | 3/2010 | Liang | F01D 5/081 416/96 R |
| 7,717,675 | B1 | 5/2010 | Liang | |
| 7,785,070 | B2 | 8/2010 | Liang | |
| 7,845,906 | B2 | 12/2010 | Spangler et al. | |
| 7,985,049 | B1 | 7/2011 | Liang | |
| 8,047,788 | B1 | 11/2011 | Liang | |
| 8,142,153 | B1 | 3/2012 | Liang | |
| 8,317,472 | B1 | 11/2012 | Liang | |
| 8,322,988 | B1 | 12/2012 | Downs et al. | |
| 8,398,370 | B1 | 3/2013 | Liang | |
| 8,444,386 | B1 | 5/2013 | Liang | |
| 8,562,295 | B1 | 10/2013 | Liang | |
| 8,608,430 | B1 | 12/2013 | Liang | |
| 8,628,298 | B1 | 1/2014 | Liang | |
| 8,678,766 | B1 | 3/2014 | Liang | |
| 8,790,083 | B1 | 7/2014 | Liang | |
| 8,864,469 | B1 | 10/2014 | Liang | |
| 9,145,780 | B2 | 9/2015 | Propheter-Hinckley et al. | |
| 9,447,692 | B1 | 9/2016 | Liang | |
| 9,970,302 | B2 | 5/2018 | Lacy et al. | |
| 2005/0058534 | A1 | 3/2005 | Lee et al. | |
| 2009/0028702 | A1 | 1/2009 | Pietraszkiewicz et al. | |
| 2009/0193657 | A1 | 8/2009 | Wilson, Jr. et al. | |
| 2010/0303625 | A1 | 12/2010 | Kuhne et al. | |
| 2013/0108471 | A1 | 5/2013 | Fujimoto | |
| 2013/0272850 | A1 | 10/2013 | Bunker | |
| 2014/0093379 | A1 | 4/2014 | Tibbott et al. | |
| 2014/0127013 | A1 | 5/2014 | Spangler et al. | |
| 2015/0041590 | A1 | 2/2015 | Kirtley et al. | |
| 2015/0044059 | A1 | 2/2015 | Wassynger et al. | |
| 2015/0096305 | A1 | 4/2015 | Morgan et al. | |
| 2015/0147164 | A1 | 5/2015 | Cui et al. | |
| 2015/0252728 | A1 | 9/2015 | Veiga | |
| 2015/0345303 | A1 | 12/2015 | Dong et al. | |
| 2016/0169003 | A1 | 6/2016 | Wong et al. | |
| 2016/0177741 | A1 | 6/2016 | Kirollos et al. | |
| 2017/0234154 | A1 | 8/2017 | Downs | |
| 2017/0350259 | A1 | 12/2017 | Dutta et al. | |
| 2018/0230815 | A1 | 8/2018 | Jones | |

OTHER PUBLICATIONS

U.S. Appl. No. 15/334,517, Office Action dated Aug. 6, 2018, 24 pages.
U.S. Appl. No. 15/334,501, Office Action dated Aug. 10, 2018, 17 pages.
U.S. Appl. No. 15/334,450, Office Action dated Aug. 15, 2018, 49 pages.
U.S. Appl. No. 15/334,563, Office Action dated Dec. 12, 2018, 18 pages.
U.S. Appl. No. 15/334,474, Office Action dated Dec. 31, 2018, 13 pages.
U.S. Appl. No. 15/334,450, Notice of Allowance dated Jan. 10, 2019, 12 pages.
U.S. Appl. No. 15/334,501, Notice of Allowance dated Jan. 17, 2019, 11 pages.
U.S. Appl. No. 15/334,454, Notice of Allowance dated Jan. 24, 2019, 23 pages.
U.S. Appl. No. 15/334,517, Notice of Allowance dated Mar. 20, 2019, 9 pgs.
U.S. Appl. No. 15/334,563, Notice of Allowance dated Apr. 9, 2019, 8 pgs.
U.S. Appl. No. 15/334,474, Notice of Allowance dated Apr. 17, 2019, 16 pgs.
U.S. Appl. No. 15/334,448, Office Action dated May 14, 2019, 8 pages.
EP Search Report for corresponding European Patent Application No. 17198212 dated May 9, 2018, 7 pages.
U.S. Appl. No. 15/334,448, Notice of Allowance dated Jun. 19, 2019, 13 pages.
U.S. Appl. No. 15/334,483, Notice of Allowance dated Jun. 20, 2019, 8 pages
U.S. Appl. No. 15/334,471, Office Action dated Jul. 11, 2019, 13 pages.

* cited by examiner

VARYING GEOMETRIES FOR COOLING CIRCUITS OF TURBINE BLADES

CROSS-REFERENCE TO RELATED APPLICATION

This application is related to co-pending U.S. application Ser. Nos. 15/334,474, 15/334,454, 15/334,563, 15/334,448, 15/334,501, 15/334,517, 15/334,450, 15/334,471, and 15/334,483, all filed on Oct. 26, 2016.

TECHNICAL FIELD

The disclosure relates generally to turbine systems, and more particularly, to varying geometries for cooling circuits for turbine blades of a turbine system.

BACKGROUND

Gas turbine systems are one example of turbomachines widely utilized in fields such as power generation. A conventional gas turbine system includes a compressor section, a combustor section, and a turbine section. During operation of a gas turbine system, various components in the system, such as turbine blades and nozzle airfoils, are subjected to high temperature flows, which can cause the components to fail. Since higher temperature flows generally result in increased performance, efficiency, and power output of a gas turbine system, it is advantageous to cool the components that are subjected to high temperature flows to allow the gas turbine system to operate at increased temperatures.

A multi-wall airfoil for a turbine blade typically contains an intricate maze of internal cooling passages. Cooling air (or other suitable coolant) provided by, for example, a compressor of a gas turbine system, may be passed through and out of the cooling passages to cool various portions of the multi-wall airfoil and/or turbine blade. Cooling circuits formed by one or more cooling passages in a u all airfoil may include, for example, internal near wall cooling circuits, internal central cooling circuits, tip cooling circuits, and cooling circuits adjacent the leading and trailing edges of the multi-wall airfoil.

SUMMARY

A first embodiment may include a trailing edge cooling system for a turbine blade. The trailing edge cooling system includes: a plurality of cooling circuits extending at least partially along a radial length of a trailing edge of the turbine blade, each cooling circuit including: an outward leg extending axially toward a trailing edge of the turbine blade; a plurality of turn legs in direct fluid communication with the outward leg, the plurality of turn legs positioned adjacent the trailing edge of the turbine blade; and a return leg positioned adjacent the outward leg and extending axially from the trailing edge of the turbine blade, the return leg including: a first portion in direct fluid communication with the plurality of turn legs, the first portion having a first width; and a second portion in direct fluid communication with the first portion, the second portion having a second width that is greater than the first width of the first portion.

Another embodiment may include a trailing edge cooling system for a turbine blade. The trailing edge cooling system includes: a cooling circuit including: an outward leg extending axially toward a trailing edge of the turbine blade, the outward leg having a width; a return leg positioned adjacent the outward leg and extending axially from the trailing edge of the turbine blade; and a plurality of turn legs in direct fluid communication with the outward leg and the return leg, the plurality of turn legs including: a first turn leg in fluid communication with the outward leg, the first turn leg having a length equal to the width of the outward leg; a second turn leg in direct fluid communication with the first turn leg, the second turn leg extending substantially perpendicular from the first turn leg; and a third turn leg in direct fluid communication with and positioned between the second turn leg and the return leg, the third turn leg extending substantially parallel to the trailing edge of the turbine blade.

A further embodiment may include a trailing edge cooling system for a turbine blade. The trailing edge cooling system includes: a cooling circuit including: a first outward leg extending axially toward a trailing edge of the turbine blade, the first outward leg having a width; a first plurality of turn legs in direct fluid communication with the first outward leg, the first plurality of turn legs including: a first turn leg in fluid communication with and extending substantially perpendicular to the first outward leg, the first turn leg having a length equal to the width of the first outward leg; a second outward leg extending axially toward the trailing edge of the turbine blade, radially below the first outward leg, the second outward leg having a width; a second plurality of turn legs in direct fluid communication with the second outward leg, the second plurality of turn legs including: a first turn leg in fluid communication with and extending substantially perpendicular to the second outward leg, the first turn leg having a length equal to the width of the second outward leg; and a return leg in direct fluid communication with the first plurality of turn legs and the second plurality of turn legs, the return leg extending axially from the trailing edge of the turbine blade between the first outward leg and the second outward leg.

The illustrative aspects of the present disclosure solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure.

Figure 1:
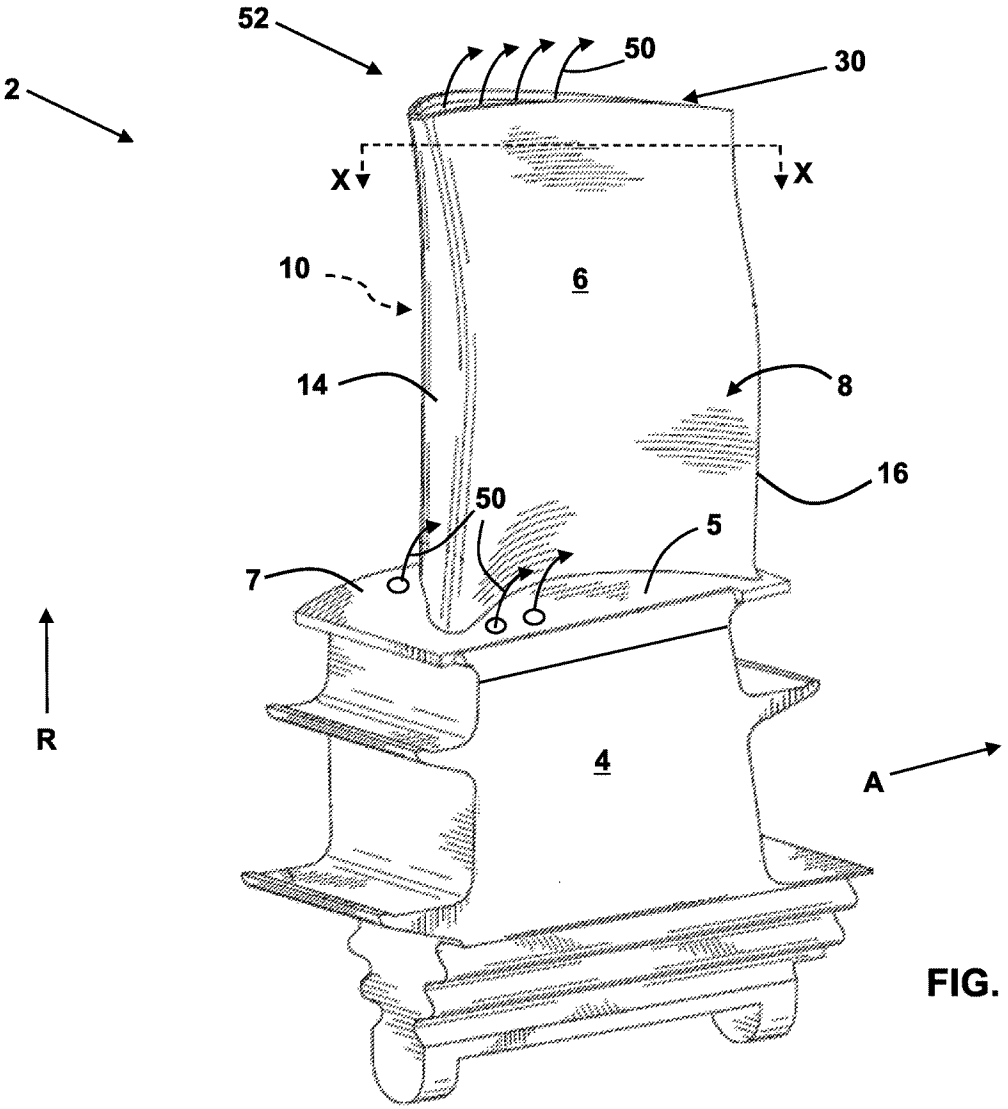
FIG. 1 is a perspective view of a turbine blade having a multi-wall airfoil according to various embodiments.

It is noted that the drawings of the disclosure are not necessarily to scale. The drawings are intended to depict only typical aspects of the disclosure, and therefore should not be considered as limiting the scope of the disclosure. In the drawings, like numbering represents like elements between the drawings.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

As indicated above, the disclosure relates generally to turbine systems, and more particularly, to varying geometries of cooling circuits for turbine blades of a turbine system. As used herein, an airfoil of a turbine blade may include, for example, a multi-wall airfoil for a rotating turbine blade or a nozzle or airfoil for a stationary vane utilized by turbine systems.

According to embodiments, a trailing edge cooling circuit with flow reuse is provided for cooling a turbine blade, and specifically a multi-wall airfoil, of a turbine system (e.g., a gas turbine system). A flow of coolant is reused after flowing through the trailing edge cooling circuit. After passing through the trailing edge cooling circuit, the flow of coolant may be collected and used to cool other sections of the airfoil and/or turbine blade. For example, the flow of coolant may be directed to at least one of the pressure or suction sides of the multi-wall airfoil of the turbine blade for convection and/or film cooling. Further, the flow of coolant may be provided to other cooling circuits within the turbine blade, including tip, and platform cooling circuits.

Traditional trailing edge cooling circuits typically eject the flow of coolant out of a turbine blade after it flows through a trailing edge cooling circuit. This is not an efficient use of the coolant, since the coolant may not have been used to its maximum heat capacity before being exhausted from the turbine blade. Contrastingly, according to embodiments, a flow of coolant, after passing through a trailing edge cooling circuit, is used for further cooling of the multi-wall airfoil and/or turbine blade.

In the Figures (see, e.g., FIG. 10), the "A" axis represents an axial orientation. As used herein, the terms "axial" and/or "axially" refer to the relative position/direction of objects along axis A, which is substantially parallel with the axis of rotation of the turbine system (in particular, the rotor section). As further used herein, the terms "radial" and/or "radially" refer to the relative position/direction of objects along an axis "R" (see, e.g., FIG. 1), which is substantially perpendicular with axis A and intersects axis A at only one location. Finally, the term "circumferential" refers to movement or position around axis A (e.g., axis "C").

Turning to FIG. 1, a perspective view of a turbine blade 2 is shown. Turbine blade 2 includes a shank 4 and a multi-wall airfoil 6 coupled to and extending radially outward from shank 4. Multi-wall airfoil 6 includes a pressure side 8, an opposed suction side 10, and a tip area 52. Multi-wall airfoil 6 further includes a leading edge 14 between pressure side 8 and suction side 10, as well as a trailing edge 16 between pressure side 8 and suction side 10 on a side opposing leading edge 14. Multi-wall airfoil 6 extends radially away from a pressure side platform 5 and a suction side platform 7.

Shank 4 and multi-wall airfoil 6 of turbine blade 2 may each be formed of one or more metals (e.g., nickel, alloys of nickel, etc.) and may be formed (e.g., cast, forged or otherwise machined) according to conventional approaches. Shank 4 and multi-wall airfoil 6 may be integrally formed (e.g., cast, forged, three-dimensionally printed, etc.), or may be formed as separate components which are subsequently joined (e.g., via welding, brazing, bonding or other coupling mechanism).

Figure 2:
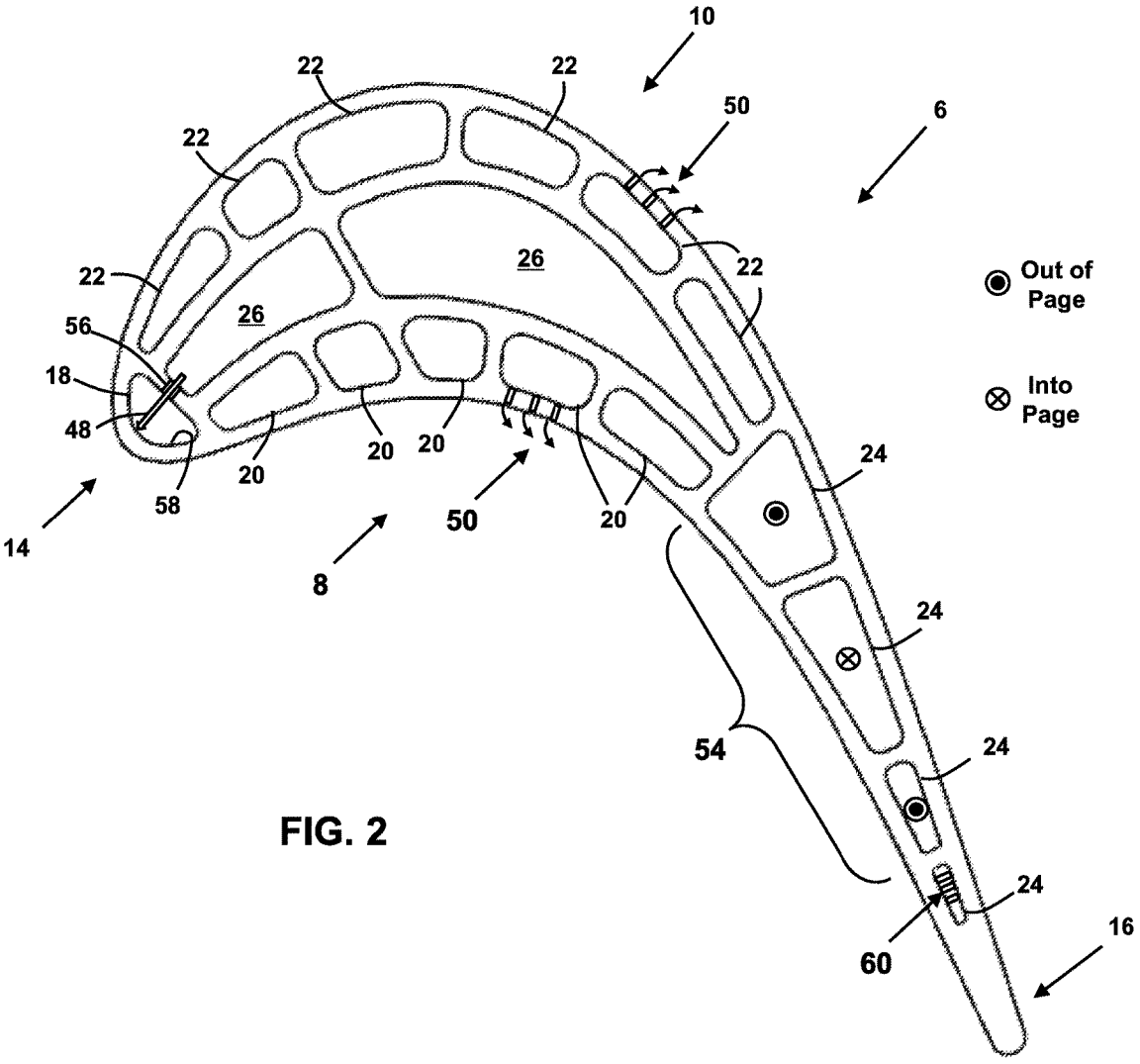
FIG. 2 is a cross-sectional view of the turbine blade of FIG. 1, taken along line X-X in FIG. 1 according to various embodiments.

FIG. 2 depicts a cross-sectional view of multi-wall airfoil 6 taken along line X-X of FIG. 1. As shown, multi-wall airfoil 6 may include a plurality of internal passages. In embodiments, multi-wall airfoil 6 includes at least one leading edge passage 18, at least one pressure side (near wall) passage 20, at least one suction side (near wall) passage 22, at least one trailing edge passage 24, and at least one central passage 26. The number of passages 18, 20, 22, 24, 26 within multi-wall airfoil 6 may vary, of course, depending upon for example, the specific configuration, size, intended use, etc., of multi-wall airfoil 6. To this extent, the number of passages 18, 20, 22, 24, 26 shown in the embodiments disclosed herein is not meant to be limiting. According to embodiments, various cooling circuits can be provided using different combinations of passages 18, 20, 22, 24, 26.

Figure 3:
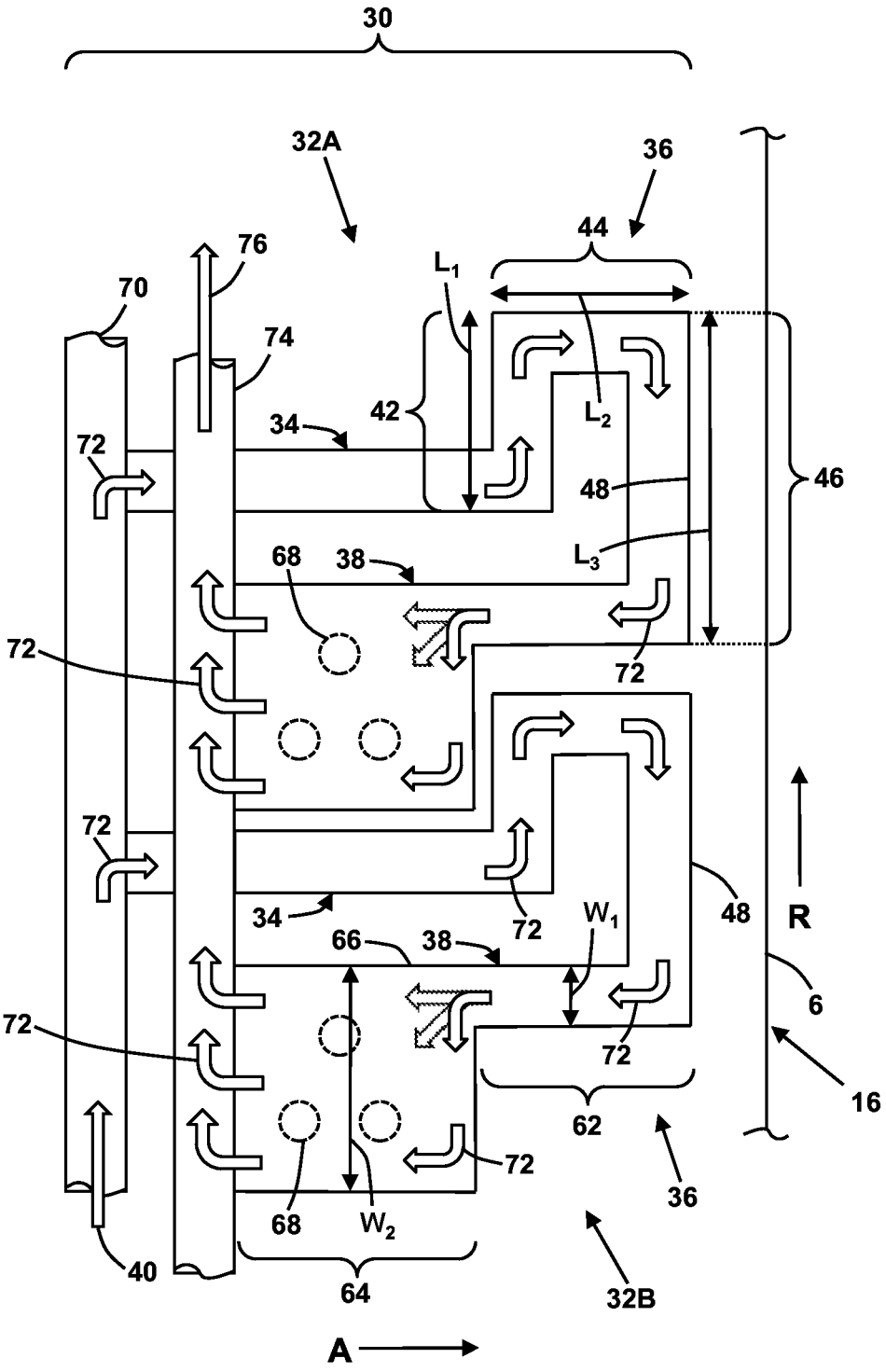
FIG. 3 is a side view of cooling circuits including a plurality of turn legs of a trailing edge cooling system according to various embodiments.
Figure 4:
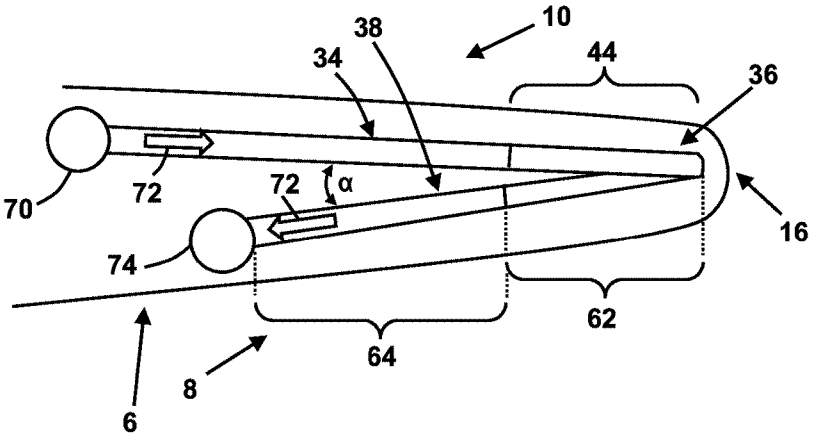
FIG. 4 is a top cross-sectional view of the cooling circuit of FIG. 3 according to various embodiments.
Figure 5:
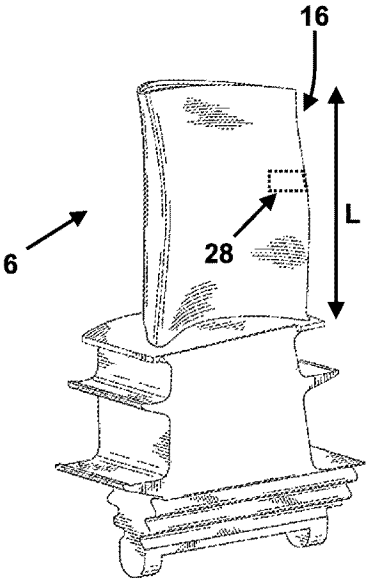
FIG. 5 depicts the section shown in FIGS. 3 and 4 of the turbine blade of FIG. 1 according to various embodiments.

An embodiment including a trailing edge cooling system 30 is depicted in FIGS. 3-5. As the name indicates, trailing edge cooling system 30 is located adjacent trailing edge 16 of multi-wall airfoil 6, between pressure side 8 and suction side 10 of multi-wall airfoil 6.

Trailing edge cooling system 30 includes a plurality of radially spaced (i.e., along the "R" axis (see, e.g., FIG. 1)) cooling circuits 32 (e.g., first cooling circuit 32A, second cooling circuit 32B) (see, e.g., FIG. 3), and each cooling circuit 32 including an outward leg 34, a plurality of turn legs 36, and a return leg 38. Outward leg 34 extends axially toward and/or substantially perpendicular to trailing edge 16 of multi-wall airfoil 6. Return leg 38 extends axially toward leading edge 14 of multi-wall airfoil 6. Additionally as shown in FIG. 3, return leg 38 extends axially away from and/or substantially perpendicular to trailing edge 16 of multi-wall airfoil 6. As such, outward leg 34 and return leg 38 may be, for example, positioned and/or oriented substantially in parallel with respect to one another. Return leg 38 for each cooling circuit 32 forming trailing edge cooling system 30 may be positioned below and/or closer to shank 4 of turbine blade 2 than the corresponding outward leg 34 in fluid communication with return leg 38. As discussed herein, return leg 38 of each cooling circuit 32 may include distinct portions having distinct, widths, thicknesses and/or geometries to ensure substantially all portions of multi-wall airfoil 6 are cooled and/or enhanced heat transfer occurs within multi-wall airfoil 6.

Although only two cooling circuits 32 (e.g., first cooling circuit 32A, second cooling circuit 32B) of trailing edge cooling system 30 are shown in FIG. 3, it is understood that multi-wall airfoil 6 utilizing and/or including trailing edge cooling system 30 may include more cooling circuits 32. In embodiments, trailing edge cooling system 30, and/or the plurality of cooling circuits 32 forming trailing edge cooling system 30, may extend along the entire radial length (L) (FIG. 5) of trailing edge 16 of multi-wall airfoil 6. In other embodiments, trailing edge cooling system 30 may partially extend along one or more portions of trailing edge 16 of multi-wall airfoil 6.

In each cooling circuit 32, outward leg 34 is radially offset along the "R" axis relative to return leg 38 by the plurality of turn legs 36. To this extent, the plurality of turn legs 36 fluidly couples outward leg 34 of cooling circuit 32 to return leg 38 of cooling circuit 32, as discussed herein. In the non-limiting embodiment shown in FIG. 3, for example, outward leg 34 is positioned radially outward relative to return leg 38 in each of cooling circuits 32. In other embodiments, in one or more of cooling circuits 32, the radial positioning of outward leg 34 relative to return leg 38 may be reversed such that outward leg 34 is positioned radially inward relative to return leg 38. A non-limiting position 28 of the portion of trailing edge cooling system 30 depicted in FIG. 3 within multi-wall airfoil 6 is illustrated in FIG. 5.

As shown in FIG. 4, in addition to a radial offset, outward leg 34 may be circumferentially offset by the plurality of turn legs 36 at an angle $\alpha$ relative to return leg 38. In this configuration, outward leg 34 extends along suction side 10 of multi-wall airfoil 6, while return leg 38 extends along pressure side 8 of multi-wall airfoil 6. The radial and circumferential offsets may vary, for example, based on geometric and heat capacity constraints on trailing edge cooling system 30 and/or other factors. In other embodiments, outward leg 34 may extend along pressure side 8 of multi-wall airfoil 6, while return leg 38 may extend along suction side 10 of multi-wall airfoil 6.

As shown in FIG. 3, the plurality of turn legs 36 may include various turn legs for (fluidly) coupling, joining and/or providing outward leg 34 to be in fluid communication with return leg 38. Specifically, outward leg 34 may be in fluid communication with return leg 38 via the plurality of turn legs 36 of cooling circuit 32, such that a coolant 40 may pass from and/or flow through outward leg 34, through the plurality of turn legs 36, and to return leg 38, as discussed herein. As shown in FIG. 3, the plurality of turn legs 36 of cooling circuit 32 may be positioned adjacent to trailing edge 16 of multi-wall airfoil 6. Specifically, one turn leg of the plurality of turn legs 36 may be positioned directly adjacent, extend radially adjacent to and/or may be substantially parallel to trailing edge 16 of multi-wall airfoil 6. As discussed in detail below, the plurality of turn legs 36 of cooling circuit 32, and specifically the turn leg of the plurality of turn legs 36 that may be positioned directly adjacent to and/or radially extend substantially parallel to trailing edge 16, may provide the greatest amount of heat transfer to cool trailing edge 16 of multi-wall airfoil 6.

In a non-limiting example shown in FIG. 3, the plurality of turn legs 36 may include a first turn leg 42, a second turn leg 44 and a third turn leg 46. First turn leg 42 of the plurality of turn legs 36 may be positioned between outward leg 34 and return leg 38, and more specifically, may be in direct fluid communication with and/or fluidly coupled with outward leg 34. First turn leg 42 may form a first turn, curve, bend and/or change in flow direction for coolant 40 within cooling circuit 32. In a non-limiting example shown in FIG. 3, first turn leg 42 may extend substantially perpendicular from outward leg 34 and return leg 38. Specifically, first turn leg 42 of the plurality of turn legs 36 may extend radially upward, away from and/or above outward leg 34, such that first turn leg 42 is positioned and/or oriented substantially perpendicular to outward leg 34. First turn leg 42 may radially extend above and/or away from outward leg 34 toward tip area 52 of multi-wall airfoil 6 (see, e.g., FIG. 1). As shown in the non-limiting example of FIG. 3, first turn leg 42 may also radially extend substantially parallel to trailing edge 16 of multi-wall airfoil 6. As a result of return leg 38 being positioned below and substantially parallel to outward leg 34, it is understood that first turn leg 42 may also be positioned substantially perpendicular to and/or may radially extend away from and/or above return leg 38.

Second turn leg 44 of the plurality of turn legs 36 may be in direct fluid communication with and/or fluidly coupled with first turn leg 42. Additionally, and as discussed herein, second turn leg 44 may be in direct fluid communication with and/or fluidly coupled with third turn leg 46, and may be positioned between first turn leg 42 and third turn leg 46 of the plurality of turn legs 36. Second turn leg 44 may form a second turn, curve, bend and/or change in flow direction for coolant 40 within cooling circuit 32 from first turn leg 42. Second turn leg 44 of the plurality of turn legs 36 may extend substantially perpendicular from first turn leg 42. Specifically in the non-limiting example shown in FIG. 3, second turn leg 44 may extend axially away from and/or may extend axially toward trailing edge 16 of multi-wall airfoil 6, such that second turn leg 44 is substantially perpendicular to first turn leg 42. As a result, second turn leg 44 may also extend substantially perpendicular to trailing edge 16 of multi-wall airfoil 6, and may be substantially parallel to outward leg 34 and/or return leg 38. As shown in FIG. 3, second turn leg 44 of cooling circuit 32 may be positioned radially above and/or closer to tip area 52 than the corresponding outward leg 34 and/or return leg 38 of cooling circuit 32.

As shown in FIG. 3, third turn leg 46 of the plurality of turn legs 36 may be in direct fluid communication with and may be positioned between second turn leg 44 and return leg 38. That is, third turn leg 46 may be positioned between second turn leg 44 and return leg 38 to fluidly couple the plurality of turn legs 36, and specifically second turn leg 44, to return leg 38 of cooling circuit 32. Similar to first turn leg 42 and second turn leg 44, third turn leg 46 may form a third turn, curve, bend and/or change in flow direction for coolant 40 within cooling circuit 32. In a non-limiting example shown in FIG. 3, third turn leg 46 of the plurality of turn legs 36 may extend substantially perpendicular to return leg 38. Specifically, third turn leg 46 may extend radially downward, away from and/or substantially below second turn leg 44 toward return leg 38 and/or shank 4 of turbine blade 2 (see, e.g., FIG. 1). Third turn leg 46 may also radially extend substantially parallel to first turn leg 42 and may extend radially adjacent to and/or substantially parallel to trailing edge 16 of multi-wall airfoil 6. Additionally, third turn leg 46 of the plurality of turn legs 36 may be positioned directly adjacent trailing edge 16 of multi-wall airfoil 6, such that no other component, cooling circuit 32 or the like is positioned between third turn leg 46 and trailing edge 16. In the non-limiting example shown in FIG. 3, at least a portion of third turn leg 46 may be positioned and/or radially extend above outward leg 34 and/or return leg 38. The portion of third turn leg 46 that may be positioned and/or radially extend above outward leg 34 and/or return leg 38 may be a portion of third turn leg 46 positioned directly adjacent second turn leg 44 and/or axially aligned with first turn leg 42. Because outward leg 34 is substantially parallel to return leg 38, it is understood that third turn leg 46 may also be positioned perpendicular to outward leg 34.

Third turn leg 46 may include a length ($L_3$) substantially longer than the remaining turn legs (e.g., first turn leg 42, second turn leg 44) of the plurality of turn legs 36 of cooling circuit 32. Specifically, third turn leg 46 may include an outer wall 48 which includes a length ($L_3$) that may be greater than the length ($L_1$) of first turn leg 42 and/or the length ($L_2$) of second turn leg 44. As shown in FIG. 3, outer wall 48 of third turn leg 46 may be substantially parallel to and may be positioned directly adjacent to trailing edge 16 of multi-wall airfoil 6. As such, outer wall 48 of third turn leg 46 may be the closest portion and/or component of cooling circuit 32 to trailing edge 16 of multi-wall airfoil 6. As discussed herein, the orientation and/or positioning of each of the turn legs of the plurality of turn legs 36, as well as the length of outer wall 48 of third turn leg 46, may improve the heat transfer within cooling circuit 32.

In the non-limiting example shown in FIG. 3, return leg 38 may include a first portion 62, and a second portion 64. First portion 62 and second portion 64 may be formed integral of each other. As such, return leg 38 including first portion 62 and second portion 64, along with the other portions or legs (e.g., outward leg 34, turn legs 36) forming cooling circuit 32, may be a single, continuous component. Alternatively, first portion 62 and second portion 64 may be formed from distinct components. In the alternative example, first portion 62 and second portion 64 may be coupled to one another, and/or to the plurality of turn legs 36, respectively, to form return leg 38.

As shown in FIG. 3, first portion 62 of return leg 38 may be in direct fluid communication with the plurality of turn legs 36 of cooling circuit 32. Specifically, first portion 62 of return leg 38 may be in direct fluid communication with third turn leg 46 of the plurality of turn legs 36. First portion 62 of return leg 38 may be substantially aligned with and/or substantially positioned below at least a portion of the plurality of turn legs 36. That is, first portion 62 may be radially aligned with the plurality of turn legs 36 of cooling circuit 32. Additionally, first portion 62 of return leg 38 may be positioned radially below first turn leg 42, second turn leg 44, and at least a portion of third turn leg 46 of the plurality of turn legs 36 of cooling circuit 32. As result, first portion 62 of return leg 38 may also be substantially positioned radially below outward leg 34.

Second portion 64 of return leg 38 may be in direct fluid communication with first portion 62 of return leg 38. As such, first portion 62 of return leg 38 may be positioned between second portion 64 and third turn leg 46 of the plurality of turn legs 36. In a non-limiting example shown in FIG. 3, second portion 64 of return leg 38 may be substantially aligned with and/or positioned substantially below outward leg 34. Specifically, second portion 64 of return leg 38 may be radially aligned with and may extend or be positioned radially below outward leg 34. Additionally as shown in FIG. 3, and as discussed herein, at least a portion of second portion 64 of return leg 38 may be radially positioned and/or may radially extend below first portion 62 of return leg 38.

First portion 62 and second portion 64 of return leg 38 may include distinct geometries. Specifically, first portion 62 and second portion 64 may each include a unique and/or distinct thickness or width (W) (or diameter where return leg 38 is substantially circular) when compared to the other portion of return leg 38. In a non-limiting example shown in FIG. 3, first portion 62 of return leg 38 may include a first width ($W_1$) and second portion 64 may include a second width ($W_2$) that is distinct from the first width ($W_1$) of first portion 62. In the non-limiting example, the second width ($W_2$) of second portion 64 may be greater than the first width ($W_1$) of first portion 62. As a result of second portion 64 having a second width ($W_2$) greater than the first width ($W_1$) of first portion 62, at least a portion of second portion 64 may be positioned radially below first portion 62 of return leg 38. Additionally in the non-limiting example, at least a portion of second portion 64 of return leg 38 may be positioned radially below first portion 62 as a result of first portion 62 and second portion 64 sharing a substantially linear inner wall 66 of return leg 38. That is, inner wall 66 of return leg 38 may be positioned substantially perpendicular to trailing edge 16 of multi-wall airfoil 6, and may extend over a single, linear plane of first portion 62 and second portion 64 of return leg 38, respectively.

As a result of second portion 64 extending and/or being positioned radially below first portion 62, second portion 64 of return leg 38 may be positioned adjacent a distinct cooling circuit 32 of trailing edge cooling system 30. For example, second portion 64 of a first cooling circuit 32A may extend radially below first portion 62 and/or may extend radially toward shank 4 of turbine blade 2 (see, FIG. 2). Second portion 64 of return leg 38 of first cooling circuit 32A may also extend radially toward a distinct or second cooling circuit 32B of trailing edge cooling system 30 positioned (radially) below first cooling circuit 32A. As shown in FIG. 3, second portion 64 of first cooling circuit 32A may be positioned axially adjacent the plurality of turn legs 36 of second cooling circuit 32B. Additionally, second portion 64 of return leg 38 of first cooling circuit 32A may be positioned radially above and in radial alignment with outward leg 34 of second cooling circuit 32B. Second portion 64 of first cooling circuit 32A may also be in radial alignment with second portion 64 of second cooling circuit 32B. As a result of second portion 64 of return leg 38 of first cooling circuit 32A extending radially downward and/or being positioned axially adjacent the plurality of turn legs 36 of second cooling circuit 32A, cooling circuits 32, and specifically return leg 38, may ensure all portions of multi-wall airfoil 6 are cooled and/or enhanced heat transfer occurs within multi-wall airfoil 6.

In a non-limiting example shown in FIG. 3, return leg 38 may also include at least one obstruction 68 (shown in phantom). Specifically, in the non-limiting example, at least one obstruction 68 may be formed and/or positioned within second portion 64 of return leg 38 of cooling circuit 32. In another non-limiting example (not shown) at least one obstruction 68 may be formed and/or positioned within first portion 62 and/or second portion 64 of return leg 38. Additionally, although obstructions 68 are depicted as being substantially uniform in shape and/or size, it is understood that the shape and/or size of obstructions 68 may vary based on the relative position of obstructions 68 within return leg 48 and/or the radial position of cooling circuits 32 within multi-wall blade 6. Additionally, although all obstructions 68 are depicted as being substantially circular, it is understood that other geometries (e.g., square, rectangle and the like) may be used in forming obstructions 68 within cooling circuit 32. Obstructions 68 may include, for example, metal pins, bumps, fins, plugs, and/or the like. As discussed herein, the inclusion of obstructions 68 within return leg 48 may enhance and/or improve heat transfer within multi-wall blade 6 that includes trailing edge cooling system 30.

A flow of coolant 40, for example, air generated by a compressor 104 of a gas turbine system 102 (FIG. 10), flows into trailing edge cooling system 30 via at least one coolant feed 70. Each coolant feed 70 may be formed, for example, using one of trailing edge passages 24 depicted in FIG. 2 or may be provided using any other suitable source or supply plenum of coolant in multi-wall airfoil 6. At each cooling circuit 32, a portion 72 of the flow of coolant 40 passes into outward leg 34 of cooling circuit 32 and flows towards the plurality of turn legs 36. Portion 72 of coolant 40 is redirected and/or moved in various directions as coolant 40 flows through the plurality of turn legs 36 of cooling circuit 32, as discussed herein. Portion 72 of coolant 40 subsequently flows into return leg 38 of cooling circuit 32 from the plurality of turn legs 36. Portion 72 of the flow of coolant 40 passing into each outward leg 34 may be the same for each cooling circuit 32. Alternatively, portion 72 of the flow of coolant 40 passing into each outward leg 34 may be different for different sets (i.e., one or more) of cooling circuits 32.

portion 72 of the flow of coolant 40 flowing through cooling circuit 32 may flow through outward leg 34 to the plurality of turn legs 36 and may subsequently be redirected and/or moved in various directions through the plurality of turn legs 36. In a non-limiting example shown in FIG. 3, portion 72 of coolant 40 flows through outward leg 34 to first turn leg 42 of the plurality of turn legs 36 and may be redirected radially upward and/or perpendicularly away from outward leg 34 as the coolant flows through first turn leg 42. Portion 72 of coolant 40 may then flow from first turn leg 42 to second turn leg 44 of the plurality of turn legs 36 of cooling circuit 32. More specifically, portion 72 of coolant 40 may be axially redirected toward trailing edge 16 of multi-wall airfoil 6 and/or may flow perpendicularly from first turn leg 42 as the coolant flows through second turn leg 44. Portion 72 of coolant 40 may subsequently flow from second turn leg 44 to third turn leg 46, and ultimately to return leg 38. In the non-limiting example shown in FIG. 3, portion 72 of coolant 40 may be radially redirected toward return leg 38 and/or may flow perpendicularly from second turn leg 44 as the coolant flows through third turn leg 46. Additionally, portion 72 of coolant 40 flowing through third turn leg 46 may flow substantially parallel to trailing edge 16 of multi-wall airfoil 6 and may flow over outer wall 48 of third turn leg 46. Once portion 72 of coolant 40 flows through third turn leg 46, it is redirected and/or moved into return leg 38. That is, portion 72 of coolant 40 is axially redirected into first portion 62 of return leg 38 from third turn leg 46 and/or redirected to flow perpendicular to and/or axially away from trailing edge 16 of multi-wall airfoil 6. Portion 72 of coolant 40 flows through first portion 62 of return leg 38 and into second portion 64 of return leg 38. Because second portion 64 of return leg 38 includes a larger geometry or width ($W_2$) than first portion 62, the flow of portion 72 of coolant 40 may expand, be redirected and/or disbursed as it enters and/or flows through second portion 64, as shown in FIG. 3.

The orientation and/or positioning of each of the turn legs of the plurality of turn legs 36 may improve the heat transfer within cooling circuit 32. That is, the orientation of each of the plurality of turn legs 36, the position or orientation (e.g., adjacent, parallel) of one turn leg (e.g., third turn leg 46) of the plurality of turn legs 36 with respect to trailing edge 16 and/or the flow path in which coolant 40 flows through the plurality of turn legs 36 may improve heat transfer and/or the cooling of trailing edge 16 of multi-wall airfoil 6 of turbine blade 2. In the non-limiting example shown in FIG. 3, a portion of the plurality of turn legs 36 (e.g., first turn leg 42, second turn leg 44) are positioned and/or oriented within cooling circuit 32 to allow for third turn leg 46 to be positioned directly adjacent to and extend radially adjacent/parallel to trailing edge 16. As a result of the position and/or orientation of third turn leg 46 with respect to trailing edge 16, the greatest amount of heat transfer may occur between third turn leg 46 and trailing edge 16 to adequately and/or desirably cool trailing edge 16 of multi-wall airfoil 6.

According to embodiments, portion 72 of coolant 40 in the plurality of cooling circuits 32 of trailing edge cooling system 30 flow out of second portion 64 of return legs 38 of cooling circuits 32 into a plenum or collection passage 74. A single plenum or collection passage 74 may be provided, however multiple plenums or collection passages 74 may also be utilized. Collection passage 74 may be formed, for example, using one of trailing edge passages 24 depicted in FIG. 2 or may be provided using one or more other passages and/or passages within multi-wall airfoil 6. Although shown as flowing radially outward through collection passage 74 in FIG. 3, the "used" coolant may instead flow radially inward through collection passage 74.

Collection coolant 76, or a portion thereof, flowing into and through collection passage 74 may be directed (e.g. using one or more passages (e.g., passages 18-24) and/or passages within multi-wall airfoil 6) to one or more additional cooling circuits of multi-wall airfoil 6. To this extent, at least some of the remaining heat capacity of collection coolant 76 is exploited for cooling purposes instead of being inefficiently expelled from trailing edge 16 of multi-wall airfoil 6.

Collection coolant 76, or a portion thereof, may be used to provide film cooling to various areas of multi-wall airfoil 6. For example, as depicted in FIGS. 1 and 2, collection coolant 76 may be used to provide cooling film 50 to one or more of pressure side 8, suction side 10, pressure side platform 5, suction side platform 7, and tip area 52 of multi-wall airfoil 6.

Collection coolant 76, or a portion thereof, may also be used in a multi-passage (e.g., serpentine) cooling circuit in multi-wall airfoil 6. For example, collection coolant 76 may be fed into a serpentine cooling circuit formed by a plurality of pressure side passages 20, a plurality of suction side passages 22, a plurality of trailing edge passages 24, or combinations thereof. An illustrative serpentine cooling circuit 54 formed using a plurality of trailing edge passages 24 is depicted in FIG. 2. In the serpentine cooling circuit 54, at least a portion of collection coolant 76 flows in a first radial direction (e.g., out of the page) through a trailing edge passage 24, in an opposite radial direction (e.g., into the page) through another trailing edge passage 24, and in the first radial direction through yet another trailing edge passage 24. Similar serpentine cooling circuits 54 may be formed using pressure side passages 20, suction side passages 22, central passages 26, or combinations thereof.

Collection coolant 76 may also be used for impingement cooling, or together with pin fins. For example, in the non-limiting example depicted in FIG. 2, at least a portion of collection coolant 76 may be directed to a central passage 26, through an impingement hole 56, and onto a forward surface 58 of a leading edge passage 18 to provide impingement cooling of leading edge 14 of multi-wall airfoil 6. Other uses of coolant 48 for impingement are also envisioned. At least a portion of collection coolant 76 may also be directed through a set of cooling pin fins 60 (e.g., within a passage (e.g., a trailing edge passage 24)). Many other cooling applications employing collection coolant 76 are also possible.

To provide additional cooling of the trailing edge of multi-wall airfoil/blade and/or to provide cooling film directly to the trailing edge, exhaust passages (not shown) may pass from any part of any of the cooling circuit(s) described herein through the trailing edge and out of the trailing edge and/or out of a side of the airfoil/blade adjacent to the trailing edge. Each exhaust passage(s) may be sized and/or positioned within the trailing edge to receive only a portion (e.g., less than half) of the coolant flowing in particular cooling circuit(s). Even with the inclusion of the exhaust passages(s), the majority (e.g., more than half) of the coolant may still flow through the cooling circuit(s), and specifically the return leg thereof, to subsequently be provided to distinct portions of multi-wall airfoil/blade for other purposes as described herein, e.g., film and/or impingement cooling.

Figure 6:
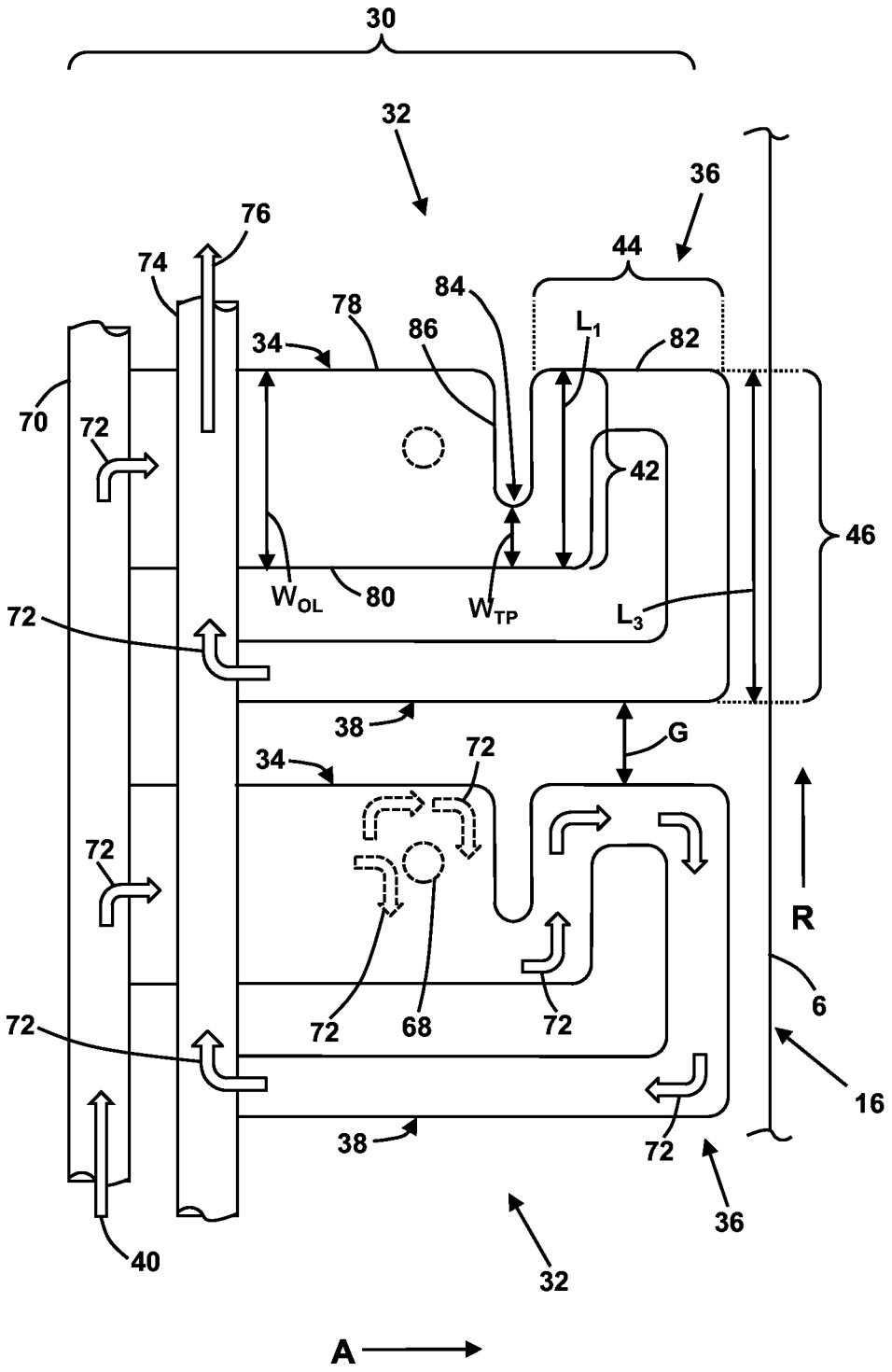
FIG. 6 is a side view of cooling circuits including a plurality of turn legs of a trailing edge cooling system according to additional embodiments.

FIG. 6 depicts another non-limiting example of a trailing edge cooling system 30 including cooling circuits 32 having a plurality of turn legs 36. It is understood that similarly numbered and/or named components may function in a substantially similar fashion. Redundant explanation of these components has been omitted for clarity.

With comparison to FIG. 3, portions or components of cooling circuits 32 depicted in FIG. 6 include distinct geometries, shapes, width, thickness and/or diameters. Specifically, outward leg 34 of cooling circuit 32 may include a thickness, height or width ($W_{OL}$) (or diameter where outward leg 34 is substantially circular). The width ($W_{OL}$) of outward leg 34 may be substantially equal to the length ($L_1$) of first turn leg 42 of the plurality of turn legs 36. That is, and as shown in FIG. 6, the width ($W_{OL}$) of outward leg 34 and the length ($L_1$) of first turn leg 42 of cooling circuit 32 may be substantially equal. In the non-limiting example shown in FIG. 3, the width ($W_{OL}$) of outward leg 34 may be substantially uniform.

Outer walls of cooling circuit 32 may also be axially and/or in planer alignment. In the non-limiting example shown in FIG. 6, outer wall 78 of outward leg 34, positioned opposite an inner wall 80 of outward leg 34, and outer wall 82 of second turn leg 44 of the plurality of turn legs 36 may both extend axially perpendicular to trailing edge 16 of multi-wall airfoil 6. As a result of the width ($W_{OL}$) of outward leg 34 being equal to the length ($L_1$) of first turn leg 42, outer wall 78 of outward leg 34 and outer wall 82 of second turn leg 44 may be in axial alignment with one another. That is, outer wall 78 of outward leg 34 and outer wall 82 of second turn leg 44 may be positioned adjacent one another and may be axially aligned and/or may be positioned or oriented on the same axial plane within multi-wall airfoil 6. Similar to the unique geometries of the cooling circuits depicted in FIG. 3, cooling circuit 32 shown in FIG. 6 may include unique, widths, thicknesses and/or geometries to ensure substantially all portions of multi-wall airfoil 6 are cooled and/or enhanced heat transfer occurs within multi-wall airfoil 6, as discussed herein.

Cooling circuit 32 depicted in FIG. 6 may also include a transition portion 84. In the non-limiting example, transition portion 84 may be positioned between outward leg 34 and the plurality of turns 36 of cooling circuit 32. Specifically, transition portion 84 may be positioned between and may be in direct fluid communication with and/or may fluidly couple outward leg 34 and the plurality of turns 36 of cooling circuit 32. As shown in FIG. 6, transition portion 84 of cooling circuit 32 may include a width ($W_{TP}$) that is less or smaller than the width ($W_{OL}$) of outward leg 34. Additionally, the width (Wiry) of transition portion 84 may be smaller or less than the length ($L_1$) of first turn leg 42 of the plurality of turn legs 36. As discussed herein, portion 72 of coolant 40 flowing through outward leg 34 may flow through transition portion 84 before flowing to the plurality of turns 36.

As shown in FIG. 6, outward leg 34 may also include an end wall 86. End wall 86 of outward leg 34 may be positioned radially above transition portion 84 of cooling circuit 32. Additionally, end wall 86 may be positioned axially adjacent first turn leg 42 of the plurality of turn legs 36 of cooling circuit 32. End wall 86 may meet and/or our join outer wall 78 of outward leg 34 and may extend radially toward transition portion 84. As shown in FIG. 6, portion 72 of coolant 40 that flows through outward leg 34 adjacent outer wall 78 may contact and subsequently be redirected and/or flow radially downward along end wall 86 of outward leg 34 before flowing through transition portion 84. The continuous movement of coolant 40 through outward leg 34 may cause, move and/or force portion 72 of coolant 40 to flow radially along end wall 86 of outward leg 34 toward transition portion 84. Additionally, the transition or corner between outer wall 78 and end wall of outward leg 34 may be substantially curved to aid in the movement of portion 72 of coolant 40 that flows through outward leg 34 adjacent outer wall 78 and radially downward toward transition portion 82.

In another non-limiting example, outward leg 34 may also include obstruction 68. That is, and as shown in FIG. 6, cooling circuit 32 may also include at least one obstruction 68 (shown in phantom) positioned and/or formed within outward leg 34. Obstruction 68 may aid in the movement of coolant 40 through outward leg 34 to transition portion 84. Specifically, obstruction 68 positioned and/or formed within outward leg 34 may be positioned adjacent outer wall 78 and/or end wall 86 and may aid in moving and/or redirecting coolant 40 flowing adjacent outer wall 78 and/or end wall 86 to transition portion 84. As shown in FIG. 6, obstruction 68, and specifically the position and/or geometry of obstruction 68, may aid in moving and/or forcing portion 72 of coolant 40 flowing directly adjacent outer wall 78 around obstruction 68 and radially downward along end wall 86 toward transition portion 84. Additionally, portion 72 of coolant 40 flowing centrally within outward leg 34 may contact and/or flow radially downward from obstruction 68 toward transition portion 84 as a result of the curved geometry and/or the position of obstruction 68 within outward leg 34.

By forming cooling circuits 32 to include the geometries, shapes, width, thickness and/or component configurations as shown and described herein with respect to FIG. 6, cooling circuits 32 may ensure substantially all portions of multi-wall airfoil 6 are adequately cooled and/or enhanced heat transfer occurs within multi-wall airfoil 6. That is, by forming outward leg 34 to include a width ($W_{OL}$) that may be equal to the length ($L_1$) of first turn leg 42, and consequently having outer wall 78 of outward leg 34 be in axial and/or planer alignment with outer wall 82 of first turn leg 42, cooling circuit 32 may be (generally) rectangular in shape. As a result, and as shown in FIG. 6, the length ($L_3$) of third turn leg 46 may also be equal to an entire width or thickness of cooling circuit 32. Each rectangular cooling circuit 32 of trailing edge cooling system 30 may be positioned adjacent and/or radially stacked on top of one another to provide a minimal gap (G) between each cooling circuit 32. By providing a minimal gap (G) between cooling circuits 32, cooling circuits 32 of trailing edge cooling system 30 may substantially fill and/or occupy the majority of the portion of multi-wall airfoil 6 adjacent trailing edge 16. As a result, cooling circuits 32 as shown in FIG. 6 may improve, enhance and/or provide the greatest amount of heat transfer within multi-wall airfoil 6.

Figure 7:
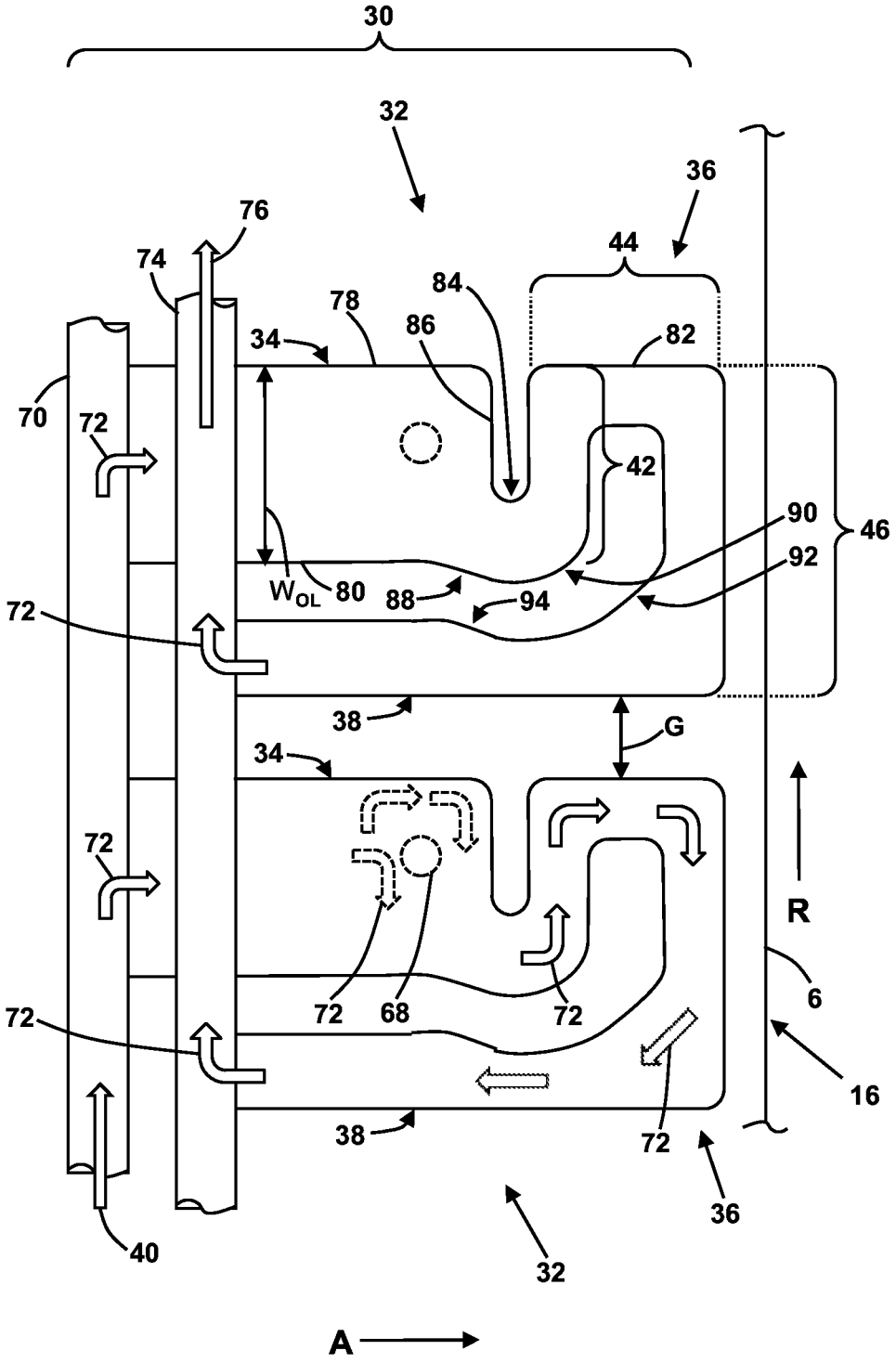
FIG. 7 is a side view of cooling circuits including a plurality of turn legs of a trailing edge cooling system according to further embodiments.

FIG. 7 depicts an additional non-limiting example of a trailing edge cooling system 30 including cooling circuits 32 having a plurality of turn legs 36. With comparison to FIG. 6, cooling circuits 32 depicted in FIG. 7 may include additional contours and/or curves in various portions and/or components to aid in the movement of portion 72 of coolant 40 flowing through cooling circuit 32. Specifically, at least one wall forming outward leg 34, the plurality of turn legs 36 and/or return leg 38 may include a curve and/or contoured portion to substantially control the flow of coolant 40, decrease separation of coolant 40, and/or reduce the risk of a pressure drop for coolant 40 as coolant 40 moves through cooling circuit 32.

In a non-limiting example shown in FIG. 7, inner wall 80 of outward leg 34 may include a contoured portion 88. Contoured portion 88 of inner wall 80 may be positioned axially adjacent transition portion 84 of cooling circuit 32. Additionally, transition portion 84 and/or first turn leg 42 of the plurality of turn legs 36 may include a curved portion 90 positioned axially adjacent contoured portion 88 of inner wall 80 of outward leg 34. As shown in FIG. 7, curved portion 90 may extend over and/or between both transition portion 84 and first turn leg 42. In another non-limiting example, only first turn leg 42 of the plurality of turn legs 36 may include curved portion 90. As discussed herein, the combination of and/or the curved geometries of contoured portion 88 of outward leg 34 and curved portion 90 of transition portion 84 and/or first turn leg 42 may improve the flow of portion 72 of coolant 40 as it flows from outward leg 34, through transition portion 84, and radially upward through first turn leg 42.

Additionally as shown in FIG. 7, third turn leg 46 of the plurality of turn legs 36 may include a curved portion 92. Curved portion 92 of third turn leg 46 may be positioned adjacent curved portion 90 of transition portion 84 and/or first turn leg 42. Specifically, curved portion 92 of third turn leg 46 may be positioned radially down from and axially adjacent to curved portion 90 of first turn leg 42. In a non-limiting example shown in FIG. 7, curved portion 92 of third turn leg 46 may correspond to curved portion 90 of first turn leg 42. That is, the geometry and/or shape of curved portion 92 of third turn leg 46 may correspond, correlate and/or be substantially similar (e.g., concentric) to the geometry and/or shape of curved portion 90 of transition portion 84 and/or first turn leg 42.

Return leg 38 of cooling circuit 32 may also include a contoured portion 94. In a non-limiting example shown in FIG. 7, contoured portion 94 of return leg 38 may be positioned adjacent contoured portion 88 of inner wall 80 of outward leg 34. Specifically, contoured portion 94 of return leg 38 may be positioned radially down from and/or in substantial radial alignment with contoured portion 88 of outward leg 34. Similar to curved portions 90, 92 of cooling circuit 32, contoured portion 94 of return leg 38 may correspond to contoured portion 88 of outward leg 34. That is, and as shown in FIG. 7, the geometry and/or shape of contoured portion 94 of return leg 46 may correspond, correlate and/or be substantially similar (e.g., parallel) to the geometry and/or shape of contoured portion 88 of inner wall 80 of outward leg 34.

As similarly discussed herein with respect to FIG. 6, each cooling circuit 32 of trailing edge cooling system 30 depicted in FIG. 7 may be (generally) rectangular in shape. As a result, each rectangular cooling circuit 32 may be positioned adjacent and/or radially stacked on top of one another to provide a minimal gap (G) between each cooling circuit 32 to substantially fill and/or occupy the majority of the portion of multi-wall airfoil 6 adjacent trailing edge 16. This positioning and/or stacking may improve, enhance and/or provide the greatest amount of heat transfer within multi-wall airfoil 6.

Although a portion 72 of coolant 40 is only depicted in a single cooling circuit 32 in FIGS. 6 and 7, it is understood that each cooling circuit 32 of trailing edge cooling system 30 depicted in FIGS. 6 and 7 may receive coolant 40, as discussed herein.

Figure 8:
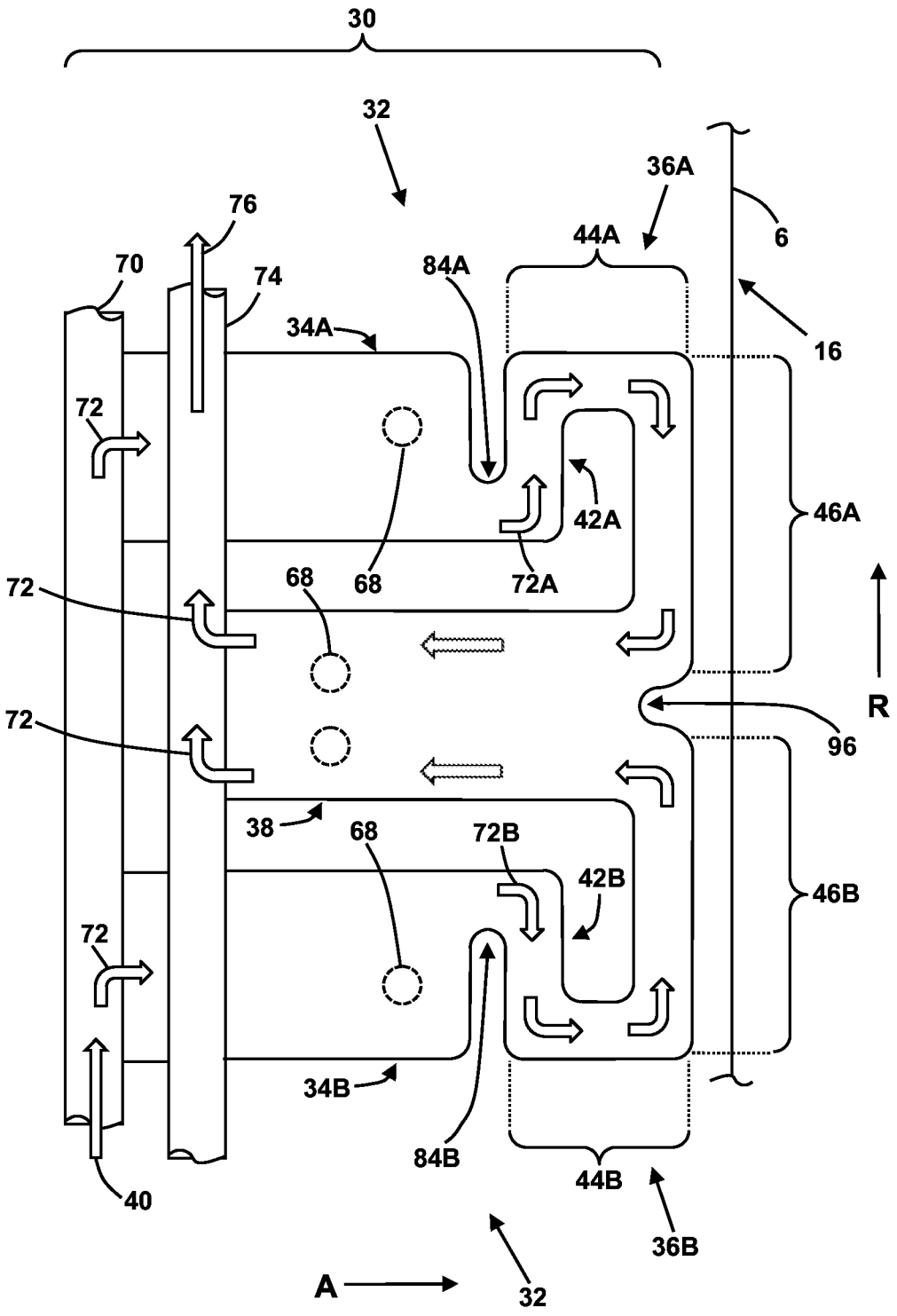
FIG. 8 is a side view of a cooling circuit including a plurality of turn legs and a single, shared return leg of a trailing edge cooling system according to various embodiments.
Figure 9:
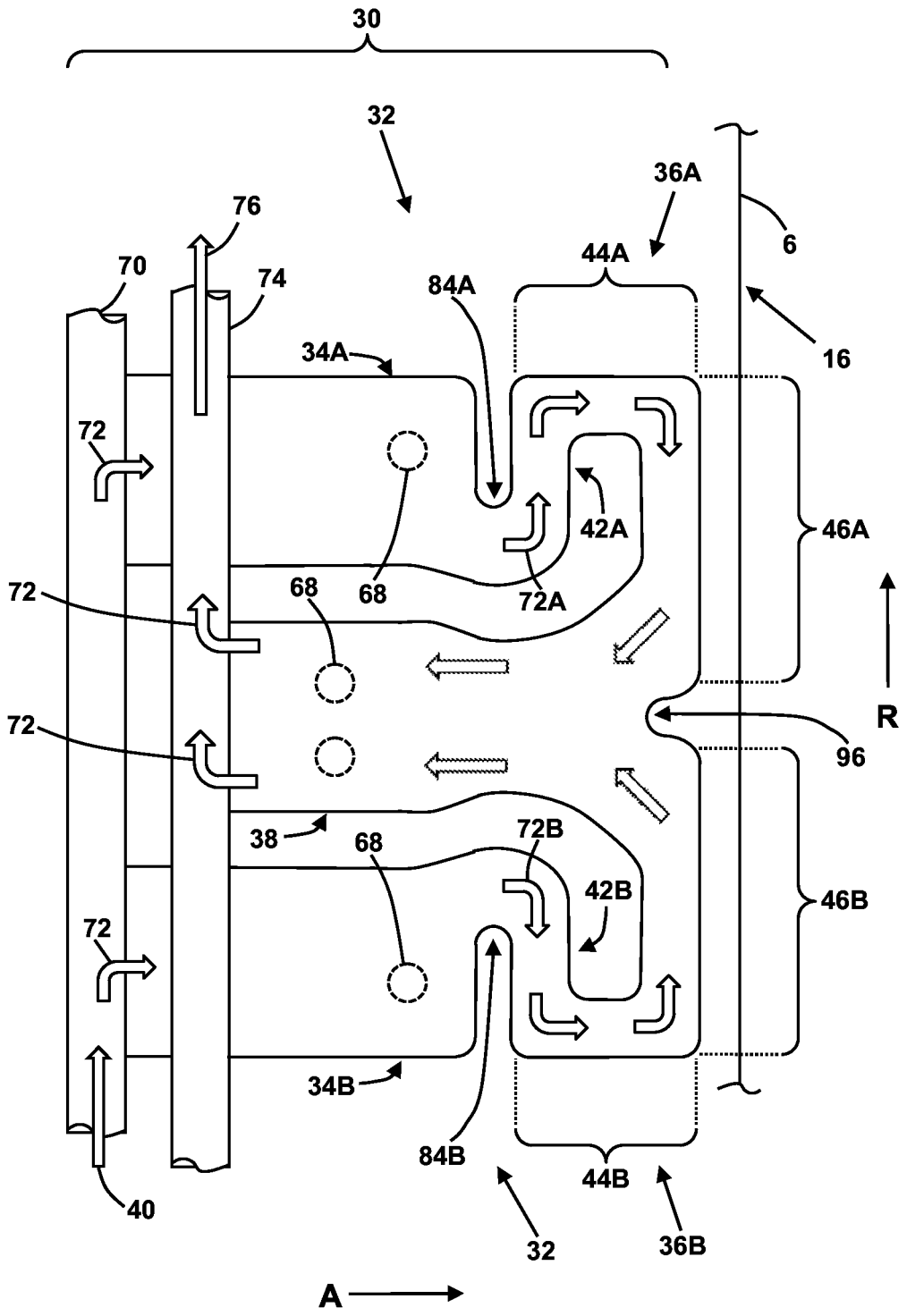
FIG. 9 is a side view of a cooling circuit including a plurality of turn legs and a single, shared return leg of a trailing edge cooling system according to additional embodiments.

FIGS. 8 and 9 depict additional, non-limiting examples of cooling circuit 32 of trailing edge cooling system 30. Portions of cooling circuit 32 shown in FIGS. 8 and 9 may be substantially similar to cooling circuits previously discussed. Specifically, outward legs 34A, 34B, transition portions 84A, 84B, and the plurality of turn legs 36A, 36B of cooling circuit 32 shown in FIG. 8 may be configured, formed and/or function in a substantially similar fashion as outward leg 34 and the plurality of turn legs 36 shown and discussed herein with respect to FIG. 6. Additionally, outward legs 34A, 34B, transition portions 84A, 84B, and the plurality of turn legs 36A, 36B of cooling circuit 32 shown in FIG. 9 may be configured, formed and/or function in a substantially similar fashion as outward leg 34 and the plurality of turn legs 36 shown and discussed herein with respect to FIG. 7. As discussed in detail below, other portions of cooling circuit 32 may be formed and/or function in a distinct manner. As a result, at least a portion of coolant 40 may flow through cooling circuit 32 shown in FIGS. 8 and 9 in a unique or distinct path.

First outward leg 34A may be substantially similar to second outward legs 34B of cooling circuits 32. Additionally, the first plurality of turn legs 36A (e.g., first turn leg 42A, second turn leg 44A, third turn leg 46A) may be substantially similar to the second plurality of turn legs 36B (e.g., first turn leg 42B, second turn leg 44B, third turn leg 46B). However, second outward leg 34B and the second plurality of turn legs 36B may be oriented, formed and/or positioned as a "mirror image" of first outward leg 34A and first plurality of turn legs 36A, respectively. As a result, the flow of portion 72 of coolant 40 through the second plurality of turn legs 36B may be distinct and/or opposite than the flow of coolant 40 through the first plurality of turn legs 36A. As shown in FIGS. 8 and 9, portion 72B of coolant 40 may flow through second outward leg 34B in a substantially similar manner (e.g., axially toward trailing edge 16) as portion 72A of coolant 40 flowing through first outward leg 34A. However, once portion 72B of coolant 40 reaches the second plurality of turn legs 36B, the flow path may vary and/or be the opposite of the flow of portion 72A. Portion 72B of coolant 40 may flow radially downward toward shank 4 of turbine blade 2 (see, e.g., FIG. 1) when flowing through first turn leg 42B of the second plurality of turn legs 36B. Portion 72B of coolant 40 may flow axially toward trailing edge 16 of multi-wall airfoil 6 when flowing through second turn leg 44B of the second plurality of turn legs 36B, and subsequently may flow radially upward toward a single return leg 38 of cooling circuit 32, as discussed herein.

As shown in FIGS. 8 and 9, and distinct from the non-limiting examples previously discussed, two distinct sets of outward legs 34A, 34B and the plurality of turn legs 36A, 36B may share a single return leg 38. Specifically, a first plurality of turn legs 36A and a second plurality of turn legs 36B may be in direct fluid communication and/or may be fluidly coupled to single return leg 38 of cooling circuit 32. As previously discussed herein, single return leg 38 may extend perpendicular to trailing edge 16 of multi-wall turbine airfoil 6. Additionally, and as shown in FIGS. 8 and 9, single return leg 38 may extend, be positioned between and/or may be substantially parallel to first outward leg 34A and second outward leg 34B of cooling circuit 32. As discussed herein, the distinct portions 72A, 72B of coolant 40 that flows through the first plurality of turn legs 36A and the second plurality of turn legs 36B, respectively, may converge, combine and/or flow into and through single return leg 38 of cooling circuit 32.

As shown in FIGS. 8 and 9, cooling circuit 32 may also include a converging portion 96 positioned between third turn legs 46A, 46B of the first plurality of turn legs 36A and the second plurality of turn legs 36B. Converging portion 96 may be positioned directly adjacent trailing edge 16 of multi-wall airfoil 6. In the non-limiting examples shown in FIGS. 8 and 9, converging portion 96 may aid in converging, combining and/or flowing coolant 40 into and through single return leg 38 before the coolant flows from return leg 38 to collection passage 74.

As shown in FIGS. 8 and 9, cooling circuit 32 of trailing edge cooling system 30 may include at least one obstruction 68 (shown in phantom). For example, at least one obstruction 68 may be formed and/or positioned within first outward leg 34A and/or second outward leg 34B, as similarly discussed and shown herein with respect to FIGS. 6 and 7. Additionally, at least one obstruction 68 may be formed and/or positioned within single return leg 38 of cooling circuit 32, as similarly discussed and shown herein with respect to FIG. 3. It is understood that the at least one obstruction 68 positioned within first outward leg 34A, second outward leg 34B and/or single return leg 38 may be formed and/or may function in a substantially similar manner as discussed herein. As such, redundant explanation of this component is omitted for clarity.

Figure 10:
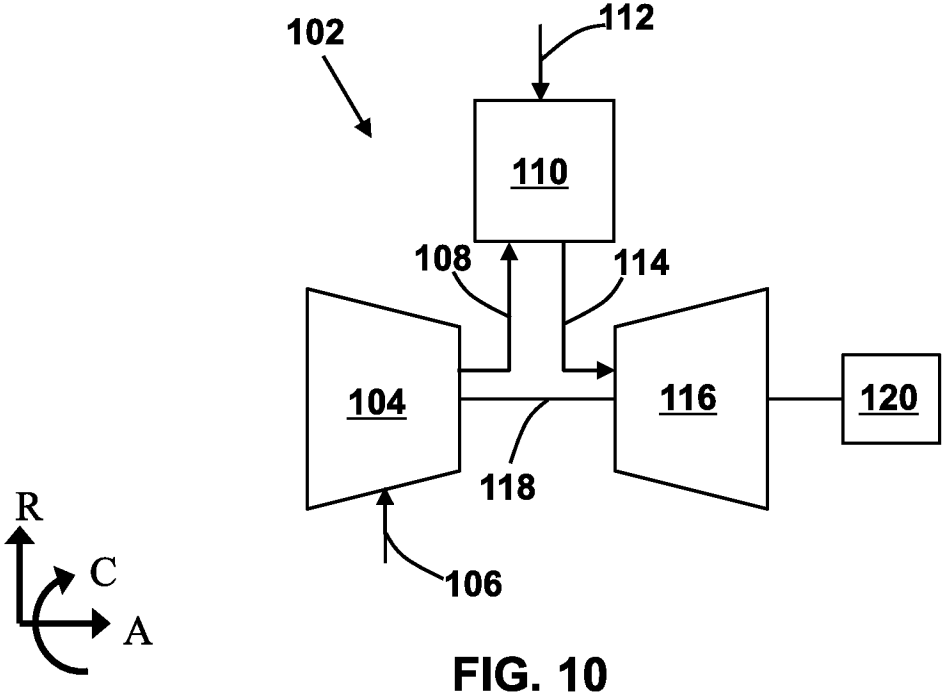
FIG. 10 is a schematic diagram of a gas turbine system according to various embodiments.

FIG. 10 shows a schematic view of gas turbomachine 102 as may be used herein. The gas turbomachine 102 may include a compressor 104. Compressor 104 compresses an incoming flow of air 106. Compressor 104 delivers a flow of compressed air 108 to a combustor 110. Combustor 110 mixes the flow of compressed air 108 with a pressurized flow of fuel 112 and ignites the mixture to create a flow of combustion gases 114. Although only a single combustor 110 is shown, gas turbine system 102 may include any number of combustors 110. The flow of combustion gases 114 is in turn delivered to a turbine 116, which typically includes a plurality of turbine blades 2 (FIG. 1). The flow of combustion gases 114 drives turbine 116 to produce mechanical work. The mechanical work produced in turbine 116 drives compressor 104 via a shaft 118, and may be used to drive an external load 120, such as an electrical generator and/or the like.

In various embodiments, components described as being "fluidly coupled" to or "in fluid communication" with one another can be joined along one or more interfaces. In some embodiments, these interfaces can include junctions between distinct components, and in other cases, these interfaces can include a solidly and/or integrally formed interconnection. That is, in some cases, components that are "coupled" to one another can be simultaneously formed to define a single continuous member. However, in other embodiments, these coupled components can be formed as separate members and be subsequently joined through known processes (e.g., fastening, ultrasonic welding, bonding).

When an element or layer is referred to as being "on", "engaged to", "connected to" or "coupled to" another element, it may be directly on, engaged, connected or coupled to the other element, or intervening elements may be present. In contrast, when an element is referred to as being "directly on," "directly engaged to", "directly connected to" or "directly coupled to" another element, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Additionally, in various embodiments, components described as being "substantially parallel" or "substantially perpendicular" with another component are understood to be exactly parallel/perpendicular to each other, or slightly angled from each other, within an acceptable range. In the latter instance, the acceptable range may be determined and/or defined as an angle that does not reduce or diminish the operation and/or function of the components described as being "substantially parallel" or "substantially perpendicular." In non-limiting examples, components discussed herein as being "substantially parallel" or "substantially perpendicular," may have no angular degree of variation (e.g., +/−0°), or alternatively, may have a small or minimal angular degree of variation (e.g., +/−15°). It is understood that the acceptable angular degree of variation discussed herein (e.g., +/−15°) is merely illustrative, and is not limiting.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A trailing edge cooling system for a turbine blade, the trailing edge cooling system comprising:
- a collection passage extending radially through the turbine blade;
- a coolant feed extending radially through the turbine blade, adjacent the collection passage; and
- a plurality of cooling circuits extending at least partially along a radial length of a trailing edge of the turbine blade, each of the plurality of cooling circuits positioned axially between the trailing edge and each of the collection passage and the coolant feed, and including:
  - an outward leg extending axially from the coolant feed, toward the trailing edge of the turbine blade, the outward leg in direct fluid communication with the coolant feed;
  - a plurality of turn legs in direct fluid communication with the outward leg, the plurality of turn legs positioned adjacent the trailing edge of the turbine blade; and
  - a return leg positioned adjacent the outward leg and extending axially from the trailing edge of the turbine blade to the collection passage, the return leg in direct fluid communication with the collection passage and including:

a first portion in direct fluid communication with the plurality of turn legs, the first portion having a first width; and a second portion in direct fluid communication with the first portion and the collection passage, the second portion having a second width that is greater than the first width of the first portion.

2. The trailing edge cooling system of claim 1, wherein the second portion of the return leg extends radially below the first portion of the return leg.

3. The trailing edge cooling system of claim 1, wherein the second portion of the return leg is positioned radially below the outward leg.

4. The trailing edge cooling system of claim 1, wherein the second portion of the return leg is radially aligned with the outward leg.

5. The trailing edge cooling system of claim 1, wherein the first portion of the return leg is radially aligned with the plurality of turn legs.

6. The trailing edge cooling system of claim 1, wherein the plurality of cooling circuits includes:

a first cooling circuit; and a second cooling circuit positioned radially below the first cooling circuit, the second portion of the return leg of the first cooling circuit positioned axially adjacent the plurality of turn legs of the second cooling circuit.

7. The trailing edge cooling system of claim 6, wherein the second portion of the return leg of the first cooling circuit is positioned radially above and aligned with the outward leg of the second cooling circuit.

8. The trailing edge cooling system of claim 1, further comprising:

at least one obstruction formed in the second portion of the return leg.

9. A trailing edge cooling system for a turbine blade, the trailing edge cooling system comprising:

a collection passage extending radially through the turbine blade;

a coolant feed extending radially through the turbine blade, adjacent the collection passage; and a plurality of cooling circuits extending at least partially along a radial length of a trailing edge of the turbine blade, each of the plurality of cooling circuits positioned axially between the trailing edge and each of the collection passage and the coolant feed, and including:

an outward leg extending axially from the coolant feed, toward and substantially perpendicular to a trailing edge of the turbine blade, the outward leg in direct fluid communication with the coolant feed and having a width;

a return leg positioned adjacent the outward leg and extending axially from and substantially perpendicular to the trailing edge of the turbine blade toward the collection passage, the return leg in direct fluid communication with the collection passage; and a plurality of turn legs in direct fluid communication with the outward leg and the return leg, the plurality of turn legs including:

a first turn leg in fluid communication with the outward leg, the first turn leg having a length equal to the width of the outward leg;

a second turn leg in direct fluid communication with the first turn leg, the second turn leg extending substantially perpendicular from the first turn leg; and a third turn leg in direct fluid communication with and positioned between the second turn leg and the return leg, the third turn leg extending substantially parallel to the trailing edge of the turbine blade.

10. The trailing edge cooling system of claim 9, wherein each of the cooling circuits of the plurality of cooling circuits further comprises:

a transition portion positioned between and in fluid communication with the outward leg and the first turn leg of the plurality of turn legs, the transition portion having a width less than the width of the outward leg.

11. The trailing edge cooling system of claim 10, wherein the outward leg of each cooling circuit of the plurality of cooling circuits further comprises:

an end wall positioned radially above the transition portion and axially adjacent the first turn leg of the plurality of turn legs.

12. The trailing edge cooling system of claim 9, wherein the outward leg of each cooling circuit of the plurality of cooling circuits further comprises:

a first outer wall extending axially perpendicular to the trailing edge of the turbine blade; and an inner wall positioned opposite the outer wall and adjacent the return leg.

13. The trailing edge cooling system of claim 12, wherein the second turn leg of each cooling circuit of the plurality of cooling circuits further comprises:

a second outer wall extending axially perpendicular to the trailing edge of the turbine blade, the second outer wall of second turn leg in axial alignment with the first outer wall of the outward leg.

14. The trailing edge cooling system of claim 12, wherein the inner wall of the outward leg of each cooling circuit of the plurality of cooling circuits further comprises a first contoured portion.

15. The trailing edge cooling system of claim 14, wherein the first turn leg of each cooling circuit of the plurality of cooling circuits further comprises a first curved portion positioned adjacent the contoured portion of the inner wall of the outer leg.

16. The trailing edge cooling system of claim 15, wherein the third turn leg of each cooling circuit of the plurality of cooling circuits further comprises a second curved portion positioned adjacent the first curved portion of the first turn leg, the second curved portion of the third turn leg corresponding to the first curved portion of the first turn leg.

17. The trailing edge cooling system of claim 14, wherein the return leg of each cooling circuit of the plurality of cooling circuits comprises a second contoured portion positioned adjacent the first contoured portion of the inner wall of the outward leg, the second contoured portion of the return leg corresponding to the first contoured portion of the inner wall of the outward leg.

18. A trailing edge cooling system for a turbine blade, the trailing edge cooling system comprising:

a collection passage extending radially through the turbine blade;

a coolant feed extending radially through the turbine blade, adjacent the collection passage; and a plurality of cooling circuits extending at least partially along a radial length of a trailing edge of the turbine blade, each of the plurality of cooling circuits positioned axially between the trailing edge and each of the collection passage and the coolant feed, and including:

a first outward leg extending axially from the coolant feed, toward and substantially perpendicular to the trailing edge of the turbine blade, the first outward leg in direct fluid communication with the coolant feed and having a width;

a first plurality of turn legs in direct fluid communication with the first outward leg, the first plurality of turn legs including:

a first turn leg in fluid communication with and extending substantially perpendicular to the first outward leg, the first turn leg having a length equal to the width of the first outward leg;

a second outward leg extending axially from the coolant feed, toward and substantially perpendicular to the trailing edge of the turbine blade, radially below the first outward leg, the second outward leg in direct fluid communication with the coolant feed and having a width;

a second plurality of turn legs in direct fluid communication with the second outward leg, the second plurality of turn legs including:

a distinct first turn leg in fluid communication with and extending substantially perpendicular to the second outward leg, the distinct first turn leg having a length equal to the width of the second outward leg; and a return leg extending axially from and substantially perpendicular to the trailing edge of the turbine blade between the first outward leg and the second outward leg and axially toward the collection passage, the return leg in direct fluid communication with:

the collection passage, the first plurality of turn legs, and the second plurality of turn legs.

19. The trailing edge cooling system of claim 18, wherein the cooling circuit further comprises at least one obstruction formed in at least one of:

the first outward leg;

the second outward leg; and the return leg.

20. The trailing edge cooling system of claim 1, wherein:

the outward leg of each of the plurality of cooling circuits extends axially toward the trailing edge of the turbine blade, adjacent one of a pressure side of the turbine blade or a suction side of the turbine blade, and the return leg of each of the plurality of cooling circuits extends axially from the trailing edge of the turbine blade, adjacent one of the pressure side of the turbine blade or the suction side of the turbine blade, opposite the outward leg.

* * * * *